US006394885B2

(12) United States Patent
Georgiou

(10) Patent No.: US 6,394,885 B2
(45) Date of Patent: May 28, 2002

(54) GRINDING MACHINE WITH SINGLE-HANDED OPERATION

(75) Inventor: Yiannis Georgiou, Voerde (DE)

(73) Assignee: Rodcraft Pneumatic Tools GmbH & Co. KG, Mülheim (DE)

( * ) Notice: Subject to any disclaimer, the term of this patent is extended or adjusted under 35 U.S.C. 154(b) by 0 days.

(21) Appl. No.: 09/756,224

(22) Filed: Jan. 9, 2001

(30) Foreign Application Priority Data

Mar. 12, 2000 (DE) ..... 100 11 161

(51) Int. Cl.[7] ..... B24B 27/08
(52) U.S. Cl. ..... 451/359; 451/344
(58) Field of Search ..... 451/344, 353, 451/357, 359, 360

(56) References Cited

U.S. PATENT DOCUMENTS 5,231,727 A * 8/1993 Armbruster
5,301,471 A * 4/1994 Fisher et al.
6,066,033 A * 5/2000 Kamiya et al. ..... 451/359
6,155,916 A * 12/2000 Rudolf et al. ..... 451/344
6,190,245 B1 * 2/2001 Heidelberger et al. ..... 451/357
6,241,594 B1 * 6/2001 Lepold ..... 451/359
6,264,408 B1 * 7/2001 Lung et al. ..... 409/182

* cited by examiner

*Primary Examiner*—Eileen P. Morgan
(74) *Attorney, Agent, or Firm*—James Creighton Wray; Meera P. Narasimhan

(57) ABSTRACT

A grinding machine 1 can be operated with just one hand because all safety- , control- and regulator devices are correlated to the top handle 3 and are therefore easy to be operated. This is for one the holding clamp 14 as the on/off switch as well as the speed setting feature 2 which can be swiveled and which slightly juts out. Left- and right-handed users with different size hands can make easy adjustments so that a high comfort level for the user is reached.

21 Claims, 5 Drawing Sheets

24
10
3
16
22
28
15
11
7
23
2
21
4

GRINDING MACHINE WITH SINGLE-HANDED OPERATION

BACKGROUND OF THE INVENTION

The invention concerns a portable grinding machine with casing which is equipped with a rotor operated grinding tool on its front and a top handle on its back as well as a speed control mechanism with which the rotation speed can be regulated via a speed setting feature.

Grinding machines are used to remove coatings, lacquer and paint from surfaces of a variety of objects and are known for example from the EP 0 577 575 or the DE-PS 39 33 885. A possible area of use for these grinding machines is the removal of paint from the exterior surfaces of vehicles where it is necessary to follow the uneven lines of such a vehicle. For this, portable machines are being used which the user can hold with one hand and set onto the surface. The speed regulation needs to be adjusted multiple times for various tasks on one object depending on whether the full surface is being worked on or if edges or hollow moldings are involved. This is accomplished by a speed control mechanism, which is operated with the other hand. In order to change the speed the machine usually has to be taken off the surface because the pressure of the grinding tool onto the surface cannot be kept constant during the regulation of the speed which then could cause damage to the surface. On many known grinding machines the switch for the speed regulation is located below the flat of the hand. Another disadvantage of most common machines is that top handles in different sizes have to be used which need to be exchanged depending on the size of the hand of the user. This is especially true for use of the same piece of equipment by left or right-handed users and different hand sizes between men and women. These four different requirements by potential users can be addressed by making the top handles exchangeable so that each user can pick a top handle that is fitted more or less suitable for him or her. However, this involves extra cost, time and effort since the machine needs to be equipped with a different top handle, which then also needs to be securely and appropriately held in place.

SUMMARY OF THE INVENTION

The task of the submitted invention is to develop a portable grinding machine for which the speed can be adjusted easily without lifting the equipment off the surface of the object and which can be operated by various users without extensive conversions.

The task of the invention is solved by enabling the speed-setting feature to swivel around an axis perpendicular to the grinding machine and placing it at the upper edge of the top handle. This enables the user to operate the equipment with one hand. The inside of the hand or the palm is placed on the top handle on the back of the equipment while the fingers, especially the index or the middle finger can operate the speed setting feature. The speed setting feature is able to swivel around an axis essentially vertical to the grinding machine thus the same direction of the axis upon which the user applies pressure on the grinding machine. During the grinding process, the speed can continuously be changed and therefore adjusted to the objective of the work depending on whether the grinding machine is used with its complete grinding surface, partial surface or with its edge. An especially even and safe operation is made possible because only one hand applies pressure onto the equipment and the surface of the work object while setting the speed. Sudden, jerky motions during the application of the grinding machine onto the surface, which were inevitable when the speed was regulated by the other hand, can therefore be avoided.

The grinding machine can be operated especially well, if the speed setting feature is positioned so that holding the top handle and operating the speed setting feature with only one hand is possible and that the speed setting feature is within reach of the index or middle finger. For this reason, the speed-setting feature is placed directly below the covering of the top handle at the upper edge of the top handle so that this feature can be reached easily. At the same time, the distance in radial direction has to allow for an easily operation for the index- and middle finger. Therefore, it is assumed that the axis of the grinding machine and the top handle are the same.

The speed setting feature is placed on the outside of the casing and corresponds with an interior speed control mechanism. To connect the parts, the speed setting feature is directly connected to the speed control mechanism via a regulator ring which is located on the inside of the top handle and is mounted on a pivot. The axis of the regulator ring corresponds with the axis of the grinding machine and the top handle. The operation of the speed-setting feature moves the regulator ring around this axis and translates this motion onto the cylindrical speed control mechanism.

The regulator ring is equipped with a covering below which the speed setting feature juts out slightly, or better, the speed setting feature is placed above its radial limits jutting out slightly. It is understood, that the radial limit of the covering is at least almost identical to the radius of the motion of the speed-setting feature.

The invented grinding machine can be powered by pressure or electricity. Functionally, a pneumatic drive is envisioned which is equipped with a supply connection as well as a vitiated air connection while the supply connection correlates to an air intake valve into the rotor area. This air intake valve, detailed in the following text, is operated by a feature which can also be operated by the same hand.

An on/off switch located at the top handle, moveable towards the top handle and slightly jutting out will be the main device to operate the machine. This piece of the equipment is fit the form of the top handle so that it can also be operated by the back of the hand. To turn the machine on, the piece is pushed towards the top handle, or more precisely the grinding machine, against the pressure of a spring or turned around an appropriate joint. If the back of the hand is lifted slightly, the same part is pushed back into its off-position due to the pressure of the spring and moves away from the top handle, so that the machine will be turned off instantly due to the interruption of the pressure supply.

The operating device and the supply connection or air intake valve are connected through a valve pestle in the operating device, which correlates to the speed control mechanism. The side of the valve pestle, which faces away from the operating device has a connection to the air intake valve. By moving the operating device towards the top handle, the valve pestle is pushed along its longitudinal axis so that the air intake bores are opened and pressurized air can flow into the rotor area. If the operating device is moved in opposite direction, the valve pestle closes the air intake bores and the air supply will be shut off. By moving the pestle, the machine can be quickly turned on and off and by turning the speed control mechanism which surrounds the pestle the rotation speed of the grinding machine can be regulated for all settings between zero and maxim power.

To regulate the speed of the grinding tool, it is suggested that the speed control mechanism has at least one, preferably two drill-holes at its end pointing towards the air intake valve. These drill-holes correlate to a air intake bore in the air intake valve. By turning the speed setting control and therefore the speed control mechanism, the drill-holes at end of the speed control mechanism will be brought into position with the air intake bores.

A preferred version of the invention intends that the drill-holes and the air intake bores are built and set to cover each other partially or completely depending on the position of the speed control mechanism. Air flows via the supply connection or the air intake valve and the drill-holes into the rotor room, depending on how far one of these drill-holes overlap with the air intake valve. The revolutions per minute of the rotor can therefore be increased or decreased through the operation of the speed setting control. At the same time, only one drill-hole at the speed control mechanism will be facing the air intake bore. Which one of the two bores depends on which side of the grinding machine the speed setting control is connected with the regulator ring.

In order to be able to install the speed setting control in different positions, the casing is to be fitted on opposite sides with two fittings with which the speed setting feature can be connected with the regulator ring preferably with the aid of screws. One and the same top handle can therefore feature the speed setting control in different positions depending on the needs of the individual user. This is especially useful for left-handed versus right-handed users who operated the speed setting control with the index finger, so that the speed setting control can be moved on the left side of the machine for use by a right handed person and on the right side of the machine for a left handed person. The casing will therefore feature different holders and the regulator ring will for example feature a thread so that it can be connected with the speed-setting feature in various positions. Regardless of the position of the speed setting feature on the left or right side of the machine, the regulator ring will be moved with the same degree while this turning motion will correlate to the speed control mechanism.

Users with different hand sizes, especially male and female users, will be accommodated through at least two consecutive fittings on each side of the grinding machine through which the speed control feature can be connected with the regulator ring, preferably with the aid of screws. In connection with the shape of the top handle, which will be detailed at a later point, and the width of the top handle which tapers off there are two fittings on each side of the grinding machine which can hold the speed setting feature in place. This ensures as well, that different users, right handed and left handed users as well as users with different hand sizes, can uses this machine with just one hand, since the speed setting feature is always positioned within reach of the index finger. Due to the connection of the speed setting feature and the fittings, or more precisely regulator ring, it is possible to change the features of the top handle quickly and without additional replacement or supplementary parts.

To improve the handling of the grinding machine, it is also intended that the top handle is molded to accommodate a human hand by tapering off on its sides and by giving the covering a ergonomically curved surface. This enables a precise guiding of the grinding machine over the surface of the work object. The curved surface is fit to accommodate the inside of the hand while the speed setting feature is positioned within reach of the index- or middle finger. This especially makes it possible to apply consistent pressure onto the surface of the work object while being able to vary the speed of the grinding tool during the grinding process.

In addition, the top handle becomes functionally narrower in its width towards the supply connection. This shall enable users with different hand sizes, especially female and male users, to hold and guide the grinding machine, or more precisely the top handle, comfortably and safely during the work process. For this reason, the top handle features tapered sides, which allow the top handle to be held well by one hand.

In order to avoid an unintended operation of the grinding machine, it is intended that the grinding machine is equipped with a safety feature on its back which can block the operation of the top handle. The top handle can only be operated after the safety feature has been removed from its blocking position. It therefore prevents the holding clamp from being unintentionally moved towards the top handle, or more precisely the grinding tool. Therefore the holding clamp features a space, which corresponds with the fit of the safety feature.

A further functional development of the grinding machine is to equip the grinding machine with a vacuum connection that correlates to the grinding tool. This vacuum connection sucks away shavings and particles which were removed from the surface of the object during the grinding process so that they cannot get into the air or onto the object. For this reason, the vacuum connection sits right in the area of the grinding tool or better the protective casing.

In another version of the invention, the vitiated air connection and the vacuum connection are combined in one common connection. Thus, the shavings and particles, in other words the material that is being removed from the object, can be disposed directly via a combined connection. The grinding machine can also have a separate vitiated air connection and a separate vacuum connection.

The invention is distinguished by the fact, that it presents a portable grinding machine with which the surface of an object can be worked on by just one hand as an innovation. All safety-, control- and regulator features can be reached and operated single handedly. This is true for the on/off switch for the operation on the back of the top handle, an additional safety feature and especially for the speed control mechanism, which can be moved and operated with the index finger. The speed control feature can be detached from the top handle and set in at least four different positions for right- and left handed users as well as users with different hand sizes. The top handle is therefore not round but features a curved surface, also, the machine slowly increases in height from its back end to the a front in a soft line, so that the user can put the entire hand on the casing and guide the grinding machine safely.

Additional details and advantages can be seen in the following description of the corresponding drawing, in which a preferred example with the necessary details and individual parts is depicted.

It shows:

DETAILED DESCRIPTION

Figure 1:
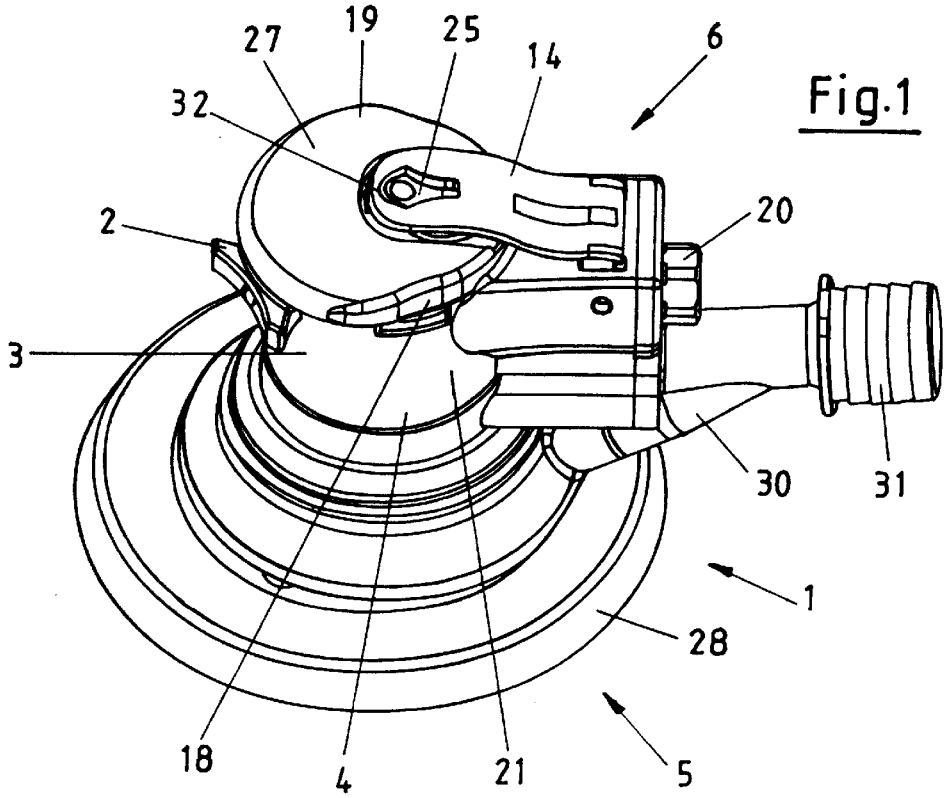
FIG. 1 grinding machine in perspective view

FIG. 1 shows the front 5 of a grinding machine 1 with casing 4 and the grinding tool which cannot be seen because it is covered by the protective case 28. On the back 6 of the grinding machine 1 is the top handle 3 which can be advantageously held single handedly for operation while being able to operate all safety-, control and regulating features. The inside of the hand of the user lies on the covering 27 of the top handle 3 whose surface 19 is curved. With the inside of the hand the holding clamp 14 is moved against the pressure of a spring towards the top handle 3, presuming the safety feature 25 is unlocked. For this, the holding clamp 14 features a corresponding fitting to accommodate the safety feature 25. If this safety feature 25 blocks the holding clamp 14, it cannot be moved towards the top handle 3. Furthermore, there are fittings 24 at the side 21 of the grinding machine 1, here in the area of the casing 27, which become narrower towards the supply connection 20 on the back end of the grinding machine 1. The user can reach the speed setting feature 2 at the upper edge 10 of top handle 3 especially easily and safely with the index finger.

The model in this version is a pneumatically powered grinding machine 1 which features a supply connection 20 as well as a vitiated air connection. Pointing into the area of the grinding tool, there is an additional vacuum connection 30 which will suck away the shavings, particles and other substances in this area that develop during the grinding process, and which are pushed through a connection 31 into a collection device together with the vitiated air.

Figure 2:
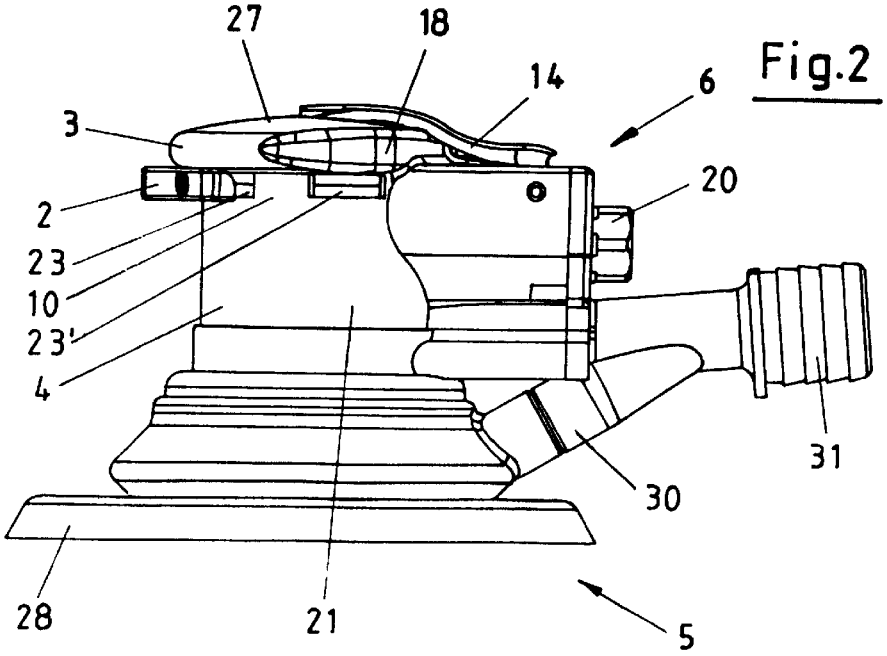
FIG. 2 grinding machine in side view
Figure 3:
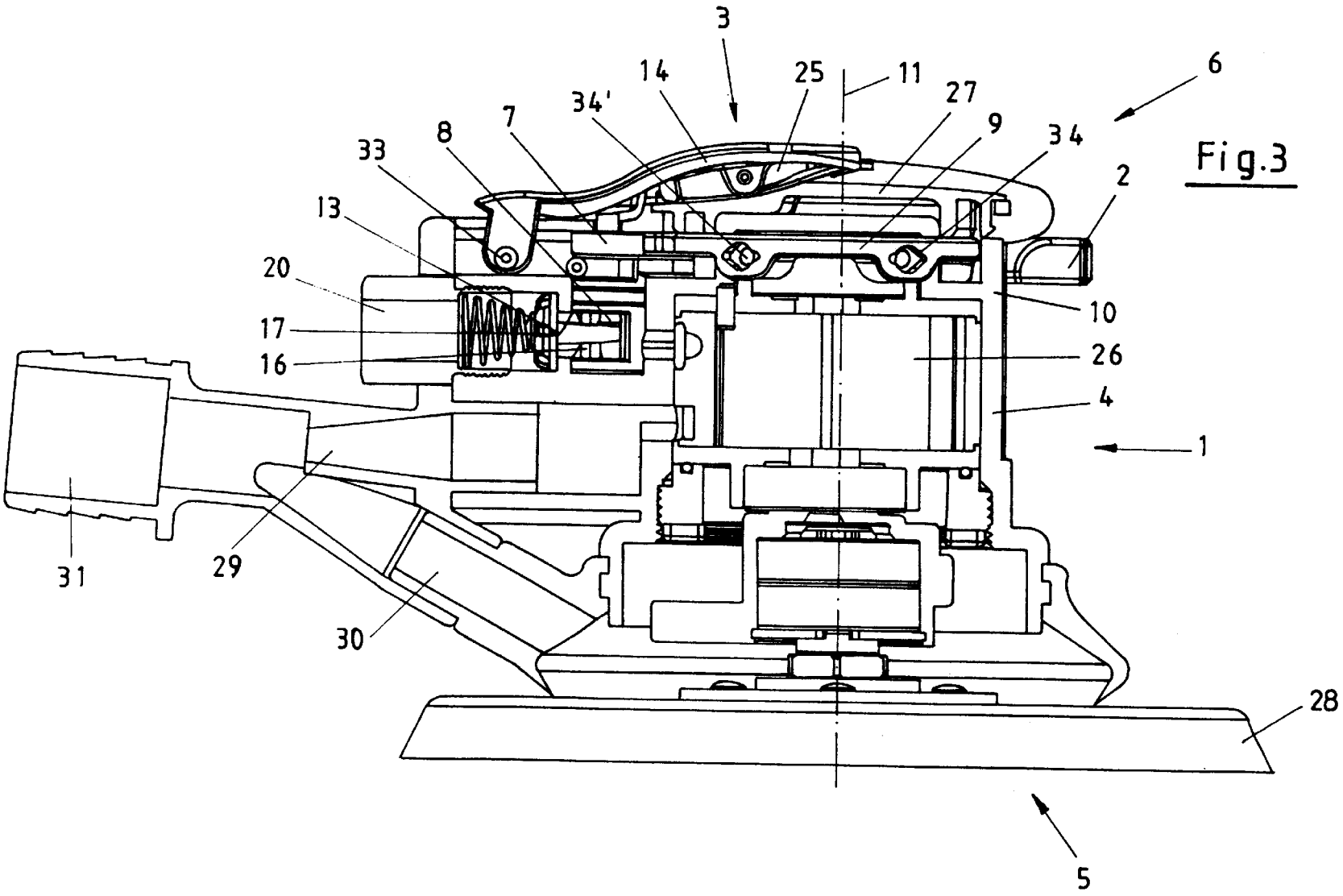
FIG. 3 grinding machine with longitudinal section

FIG. 2 depicts a grinding machine 1 in side view which especially shows the areas 18 which are shaped to support the hands or better fingers. Those can be found in the area of the top handle 3 or more precisely the casing 27. Below, you can find the speed setting feature 2 which slightly juts out from the casing 27 at the upper edge 10 of the top handle 3 so that it is located in a distance from the top handle 3 that is in reach of the index or middle finger of the user thus enabling a single handed operation of the top handle 3 and the speed setting feature 2. The minor distance in height is made clear in this depiction, radial direction in FIGS. 5 and 6. The speed setting feature 2 is positioned in the fitting 23 through which it is connected with the regulator ring, which cannot be seen here, utilizing screwed fixtures. The speed setting feature 2 can fit into the holding 23' and screws into place. In this case, the speed setting feature 2 would be located towards the top handle so that a user with a smaller hand can operate the grinding machine1.

Picture 3 depicts a longitudinal view of the grinding machine 1 which specifically shows the individual parts inside the casing 4. By moving the holding clamp 14 after unlocking the safety feature 25, the holding clamp 14 becomes the on/off switch by moving towards the top handle 3. The holding clamp therefore features a joint 33. The holding clamp 14 is related to a valve pestle 8 which is moved in the same direction. With the side that faces away from the holding clamp 14, the valve pestle 8 blocks the spring pressured air intake valve 13 or more precise the air intake bore 17. The air intake bore 17 is located directly behind the supply connection 20 for the pressurized air. If moved lengthwise, the valve pestle 8 releases the air intake bore 17, so that pressurized air can flow into the rotor area. The valve pestle 8 correlates to the speed control mechanism 7. At its end 16 which faces the air intake valve 13, the speed control mechanism features drill-holes, marked on FIG. 4 with the number 15. In relation of one of these drill-holes 15 to the air intake bore 17, the rotation speed of the grinding machine can be regulated due to the effect when the drill-hole and the air intake bore overlap to a certain extent and a corresponding amount of pressurized air flows into the rotor area so that the revolutions per minute of the rotor increase or decrease. The second drill-hole comes into effect when the speed setting feature 2 is positioned in a different fitting. The speed control mechanism 7 is controlled by the speed setting feature 2 via the regulator ring 9. The speed setting feature can be connected with the regulator ring 9 with screws in different fittings 34, 34'. The speed setting feature 2 can move around the axis 11, which in this version corresponds with the rotation axis of the grinding tool, while the motion is transferred via the regulator ring 9 to the speed control mechanism 7 and therefore the amount of released pressurized air is adjusted accordingly. It is also obvious that this version of the grinding machine 1 has one common connection 31 for the vitiated air connection 29 and the vacuum connection 30.

Figure 4:
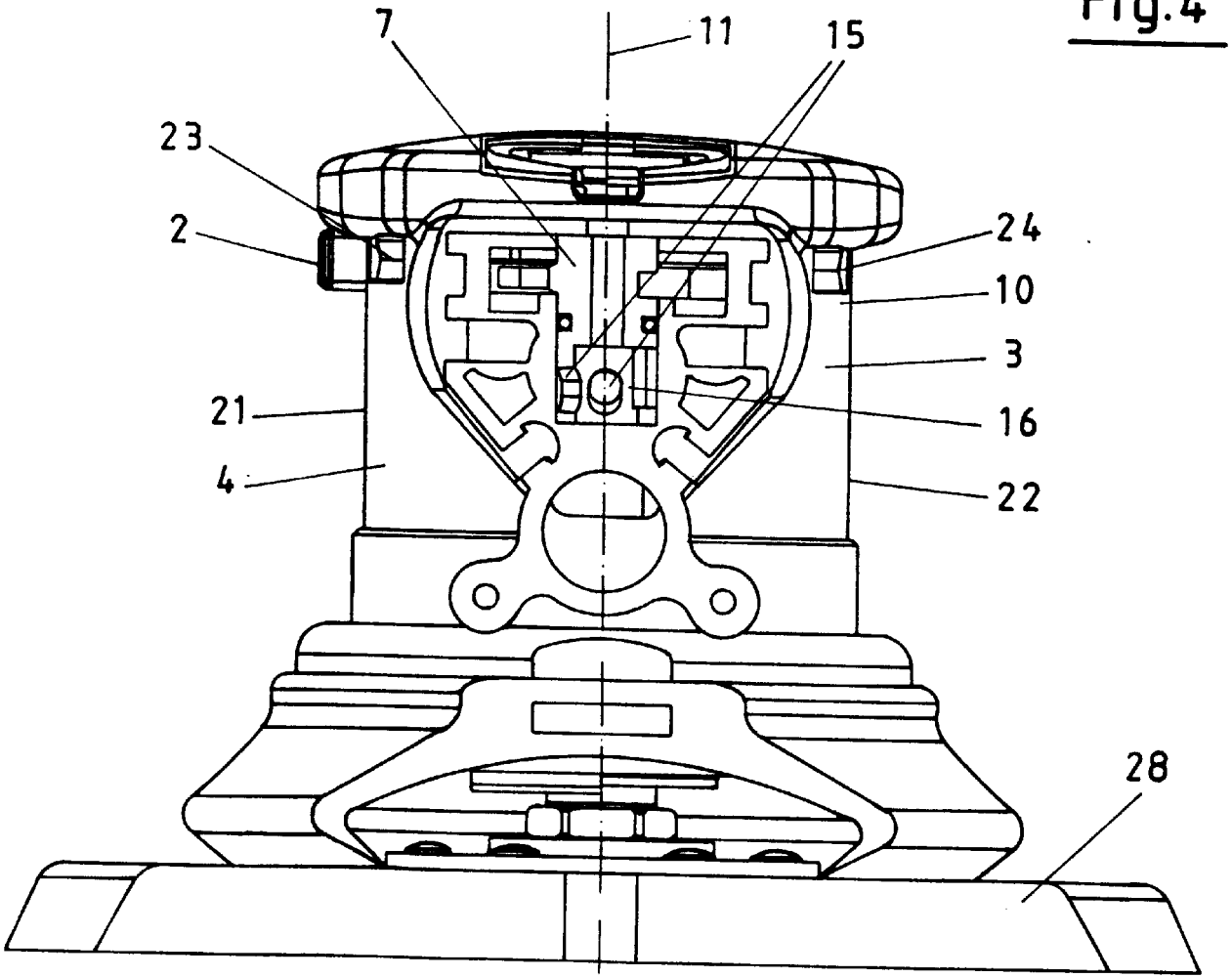
FIG. 4 grinding machine with partial cross section

FIG. 4 shows a partial cut through a grinding machine 1. You can see the two drill-holes 15 at the lower edge 16 of the speed control mechanism 7. Which one of the two drill-holes 15 is positioned opposite the air intake bores of the air intake valve depends on which side 21, 22 of the grinding machine the speed setting feature 2 is connected with the regulator ring. In this case, the speed setting feature 2 is fit for a right handed user using fitting 23 on the left side 21 in the direction of operation of the grinding machine 1. To accommodate a left handed user, the speed setting feature 2 would be set in the fitting 24 on the right side 22 where a left-handed user could reach it with the index finger. By turning the speed setting feature 2, the motion is transferred onto the speed control mechanism 7 via the regulator ring 9 so that at the end the drill-hole 15 at the lower edge 16 of the speed control mechanism 7 which corresponds to the air intake bore is fully, partially or not at all overlapping with the air intake bores. The more the drill-holes overlap the more pressurized air can flow.

Figure 5:
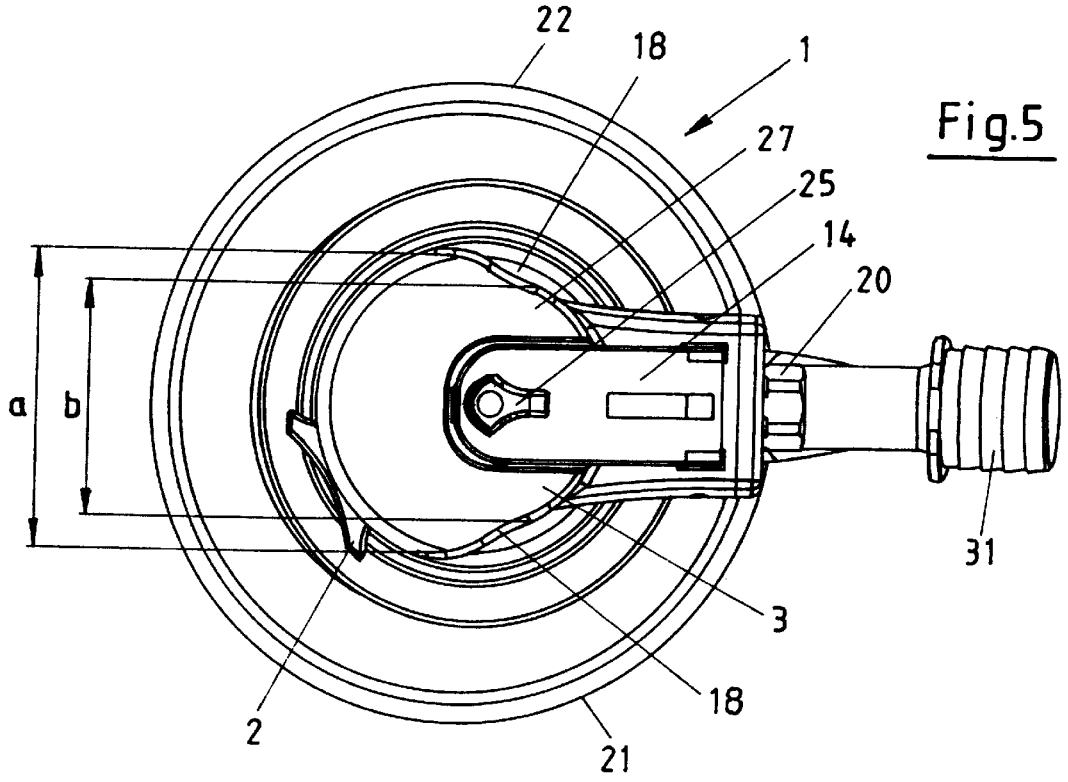
FIG. 5 grinding machine from bird's eyes view

FIG. 5 clarifies how well the invented grinding machine can be handled. You can see that the top handle 3 ergonomically fits to the inside of a human hand and that the speed setting feature 2 only juts out slightly over its outer measures so that it can be operated with the index finger. The number 18 identifies the area on the sides which tapers off towards the supply connection 20. You can easily imagine that all users, especially male and female users with different hand sizes, can hold the top handle easily. As an example, position a shows a setting for a male user and position b shows the position for a female user.

Figure 6:
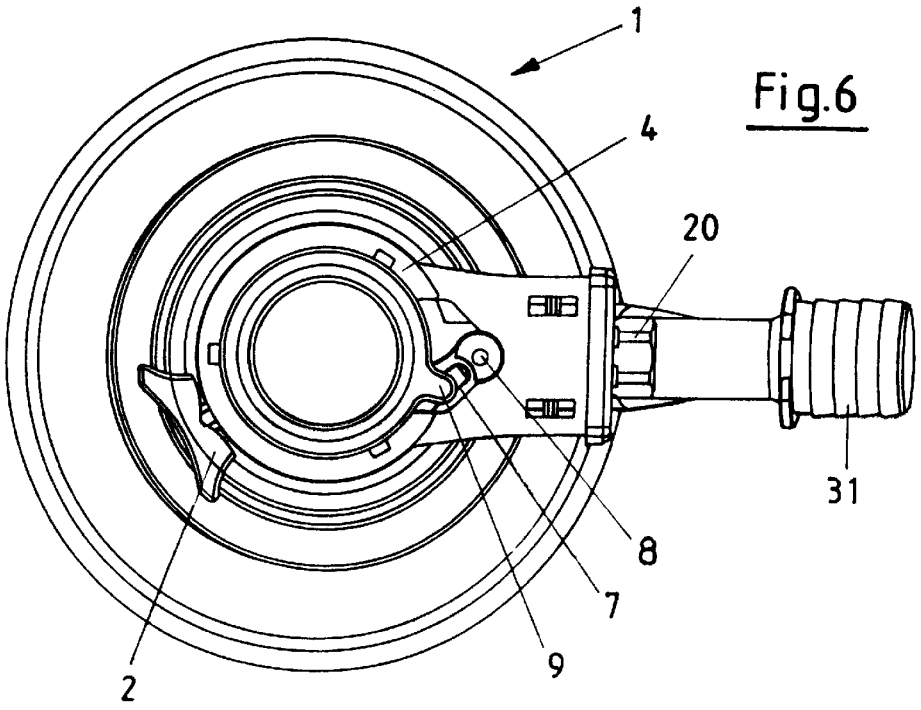
FIG. 6 grinding machine from bird's eyes view without casing and holding clamp.

In FIG. 6, the casing and the holding clamp were eliminated on the drawing so that you can see the regulator ring 9 which is being turned via the speed setting feature 2. This turning motion is being transferred onto the speed control mechanism 7 which as a result on the opposite end will bring the drill-holes which are correlated to the speed control mechanism 7 and cannot be seen on this drawing in a partially or completely overlapping position. You can also see the valve pestle 8 which can be moved by the holding clamp along its longitudinal axis to turn the grinding machine on or off. The holding clamp is not shown on this drawing.

Figure 7:
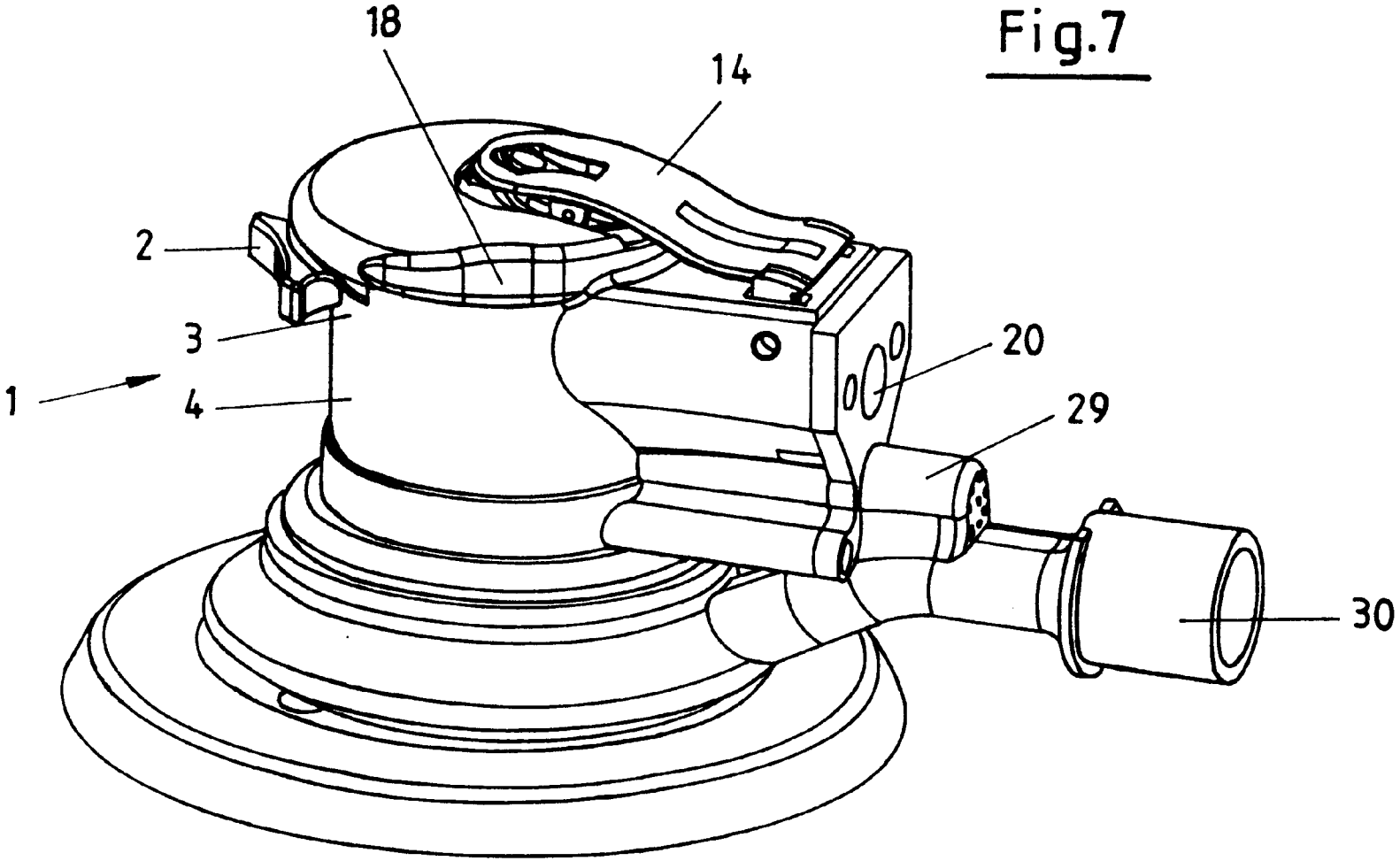
FIG. 7 grinding machine with separate vitiated air connection and vacuum connection.

FIG. 7 shows a perspective view of the grinding machine 1 with an vitiated air connection 29 separate from the vacuum connection 30. Below the supply connection 20 in the rear you will first find the vitiated air connection 29 which disposes of the air that comes out of the rotor room. Separately, there is the vacuum connection 30 through which shavings and particles that came lose during the grinding process are collected or disposed off. Whereas in FIGS. 1 through 6 the vitiated air connection and the vacuum connection were combined in one part, in another version of the invention, the two connections are built separately in FIG. 7.

All listed characteristics which are also depicted on the drawings, individually or in combination with each other are being considered essential for the invention.

What is claimed is:

1. A portable grinding machine comprising a casing, a rotor operated grinding tool on a front of the casing said grinding tool having an axis of rotation, a handle on a back of the casing, a speed control mechanism connected to the casing comprising a speed controller disposed on an upper edge of the handle for adjusting a rotation speed, and the speed controller being swivellable around said axis of rotation.

2. The grinding machine of claim 1, wherein the speed controller and the handle are operable with one hand.

3. The grinding machine of claim 2, wherein a distance between the speed controller and the handle accommodates fingers of the one hand for single-handed operation of the machine.

4. The grinding machine of claim 1, further comprising a regulator ring coupling the speed control mechanism and the speed controller and a pivot, wherein the regulator ring mounted on the pivot and is disposed on an inner side of the handle.

5. The grinding machine of claim 4, further comprising a cover on the regulator ring and an extension on the speed controller extending below the cover.

6. The grinding machine of claim 1, further comprising an air intake valve communicating with a rotor area and a pneumatic drive, the pneumatic drive comprising a supply connection and a vitiated air connection, wherein the supply connection communicates with the air intake valve.

7. The grinding machine of claim 6, further comprising a holding clamp operating as an on/off switch coupled to the handle, wherein the holding clamp extends beyond the handle and is movable towards the handle.

8. The grinding machine of claim 7, further comprising a valve pestle in operative connection with the speed control mechanism, wherein the holding clamp is coupled to the valve pestle, and wherein a side of the facing away from the holding clamp is connected to the air intake valve.

9. The grinding machine of claim 8, further comprising an air intake bore in the air intake valve and at least one drill-hole on an end of the speed control mechanism, wherein the at least one drill-hole communicates with the air intake bore.

10. The grinding machine of claim 9, further comprising two drill-holes.

11. The grinding machine of claim 9, further comprising interfitting extensions on the drill-hole and on the air intake bore, wherein the extensions completely or partially cover one another corresponding to a position of the speed control mechanism.

12. The grinding machine of claim 4, wherein the casing comprises first and second interfitting opposite sides for coupling the speed controller and the regulator ring.

13. The grinding machine of claim 12, further comprising fasteners for interfitting the opposite sides.

14. The grinding machine of claim 1, further comprising two consecutive fittings for coupling the speed controller and the regulator ring.

15. The grinding machine of claim 14, wherein the fittings comprise fasteners for the coupling.

16. The grinding machine of claim 5, wherein the handle is shaped for accommodating a human hand and the handle comprises tapered sides.

17. The grinding machine of claim 16, wherein the cover comprises an ergonomic curved surface.

18. The grinding machine of claim 6, wherein a width of the handle is narrower towards the supply connection.

19. The grinding machine of claim 7, further comprising a safety device on a rear side for blocking the holding clamp.

20. The grinding machine of claim 6, further comprising a vacuum spout communicating with the grinding tool.

21. The grinding machine of claim 20, further comprising a connector for connecting the vitiated air connection and the vacuum spout.

* * * * *